US007663076B2

(12) United States Patent
Tarry

(10) Patent No.: US 7,663,076 B2
(45) Date of Patent: Feb. 16, 2010

(54) CONDUCTIVE MATERIALS

(75) Inventor: Colin Roy Tarry, Somerset (GB)

(73) Assignee: Inditherm PLC (GB)

( * ) Notice: Subject to any disclaimer, the term of this patent is extended or adjusted under 35 U.S.C. 154(b) by 310 days.

(21) Appl. No.: 10/552,221

(22) PCT Filed: Jul. 8, 2004

(86) PCT No.: PCT/GB2004/002957

§ 371 (c)(1),
(2), (4) Date: Aug. 25, 2006

(87) PCT Pub. No.: WO2005/009079

PCT Pub. Date: Jan. 27, 2005

(65) Prior Publication Data

US 2008/0223848 A1 Sep. 18, 2008

(51) Int. Cl.
*H05B 3/34* (2006.01)
*H05B 3/00* (2006.01)

(52) U.S. Cl. ..... 219/549; 219/200; 219/211; 219/212; 219/217; 219/528; 219/529; 219/542; 219/543; 219/544; 219/545; 219/548

(58) Field of Classification Search ..... 219/200, 219/211–12, 217, 528–529, 541–5, 548–549
See application file for complete search history.

(56) References Cited

U.S. PATENT DOCUMENTS 6,403,935 B2 * 6/2002 Kochman et al. ..... 219/545
6,814,889 B1 * 11/2004 O'Grady et al. ..... 252/511

FOREIGN PATENT DOCUMENTS

WO WO 00/34959 A1 6/2000

* cited by examiner

*Primary Examiner*—Shawntina Fuqua
(74) *Attorney, Agent, or Firm*—Trexler, Bushnell, Giangiorgi, Blackstone & Marr, Ltd

(57) ABSTRACT

The invention relates to conductive materials particularly to serve as a heater. Heating means formed by or with electrically conductive materials are known and particularly effective for its flexibility is that sold under the British, Community and US Registered Trade Mark INDITHERM. Conductive rails are used to provide electrical connection to a source of power that need to have a commensurate flexibility, and the object of the invention is to ensure the maintenance of power to the full length of the conductive rail. This objective, is met by a construction comprising spaced first rails for the supply and return of electrical power, the said rails having a flexibility compatible with the semi-conductive material, and there being a supplementary rail attached to each first rail along the length thereof, the supplementary rails being flexible and having strength characteristics greater than those of the first rails.

9 Claims, 3 Drawing Sheets

CONDUCTIVE MATERIALS

RELATED/PRIORITY APPLICATION

This application is a National Phase filing regarding International Application No. PCT/GB2004/002957, which relies upon British Patent Application No. 0316327.6 for priority.

BACKGROUND OF THE INVENTION

This invention relates to conductive materials and is particularly concerned with conductive materials to serve the purpose of a heating means.

It has long been known that materials that are electrically conductive can generate heat. This phenomenon has spawned a considerable number of heating means for an equally considerable number of different purposes.

There have been attempts hitherto to create electrical heaters in sheet or web form to serve a wide variety of purposes. However the most usable form of conductive material is in the form of carbon particles or carbon black embedded in or coated on a carrier or substrate. A known difficulty with such materials is a lack of consistency in the embedded or coated carbon particles or carbon black leading to a lack of uniformity in the heating effect across a sheet or web, and the presence of hot and cold spots. In an attempt to combat this, the temptation is to increase carbon density, but the greater the density or concentration of carbon particles or carbon black, the less pliable is the sheet or web until the point is reached where the material becomes brittle. This can be tolerated in a circumstance where the sheet or web can be held rigid on a support, but not in any circumstance where a greater or lesser degree of flexibility is required of the heating means.

One known material has solved this problem, a sheet of web with a surface layer of carbon particle or carbon black of such a density that uniform heating across the full width and length of the sheet with the complete absence of hot and cold spots is achieved but with retained substantial flexibility. That material is sold under the British, Community and US Registered Trade Mark INDITHERM.

With materials such as Inditherm®, it is convenient to provide a connection to a source of electrical power by providing conductive rails on the carbon layer along the length of a web or sheet at opposite edges, those rails being such as not to impair the flexibility of the sheet. Thus, it is known to provide rails such as by screen printing of an appropriate conductive ink, and suitably connecting the rail to lead extending to an appropriate power supply or mains electricity by way of and appropriate transformer.

In all of its forms of construction, the material known as Inditherm® provides exceptional heating means where the heat is distributed evenly across its full width and length with the complete absence of hot or cold spots.

In certain circumstances, sheets of Inditherm® need to be firmly attached to or around items that need to be heated, or to supports on which are placed items that are to be provided with heat. It might well be that to ensure the positive connection of a sheet of Inditherm® in place, it needs to be clamped, and the clamps may be needed at the edges of the sheet, with a risk, albeit remote, that the conductive rail at the edge of the sheet will be damaged to an extent to disrupt the supply of electrical power along the full length of the rail.

If a rail is damaged, and the connection to mains is lost, then so would be the heating effect over a part at least of the sheet. In some usages of sheets of Inditherm® that might not be critical, and a damaged sheet replaced at relative leisure. There are, however, other usages of sheets of Inditherm® where it is vital that the heating effect over part of or the whole of the sheet of Inditherm® is maintained.

The object of the present invention is to ensure the maintenance of a supply of electrical power over the full length of a heating means in flexible sheet form.

BRIEF SUMMARY OF THE INVENTION

According to the present invention, a flexible semi-conductive material in sheet form comprises spaced first rails for the supply and return of electrical power, the said rails having a flexibility compatible with the semi-conductive material, and there being a supplementary rail attached to each first rail along the length thereof, the supplementary rails being flexible and having strength characteristics greater than those of the first rails.

Thus, the supplementary rails may be a braid formed from conductive wires, the wire diameters being of a size that affords considerable individual flexibility, but relatively low strength, but which when interwoven with other wires, forms a braid that has a flexibility that is commensurate with the flexibility of the sheet of Inditherm® and the first rails, but which has strength characteristics greater than those of the first rails, particularly when the first rails are formed by screen printing with a conductive ink.

The braid forming the supplementary rail can be attached to the respective first rail by any appropriate means such as a conductive adhesive, but preferably, attachment is by sewing of the braid along the length of its first rail.

In use, and for so long as the first rails remain undamaged, they constitute the primary route for the supply of electrical power across the sheet of semi-conductive material, with all of the benefits associated with a sheet of Inditherm®. However, if accidentally, the first rail or rails is or are damaged to an extent that would disrupt the supply of electrical power to the sheet beyond the point of damage, the supplementary rail carries the supply of electrical power beyond the damaged part, to maintain the supply of electrical power to the first rail and hence to the semi-conductive sheet beyond the damaged sector.

BRIEF DESCRIPTION OF THE SEVERAL VIEWS OF THE DRAWINGS

Several embodiments of the invention will now be described with reference to the accompanying drawings in which:—

DETAILED DESCRIPTION OF THE INVENTION

Figure 1:
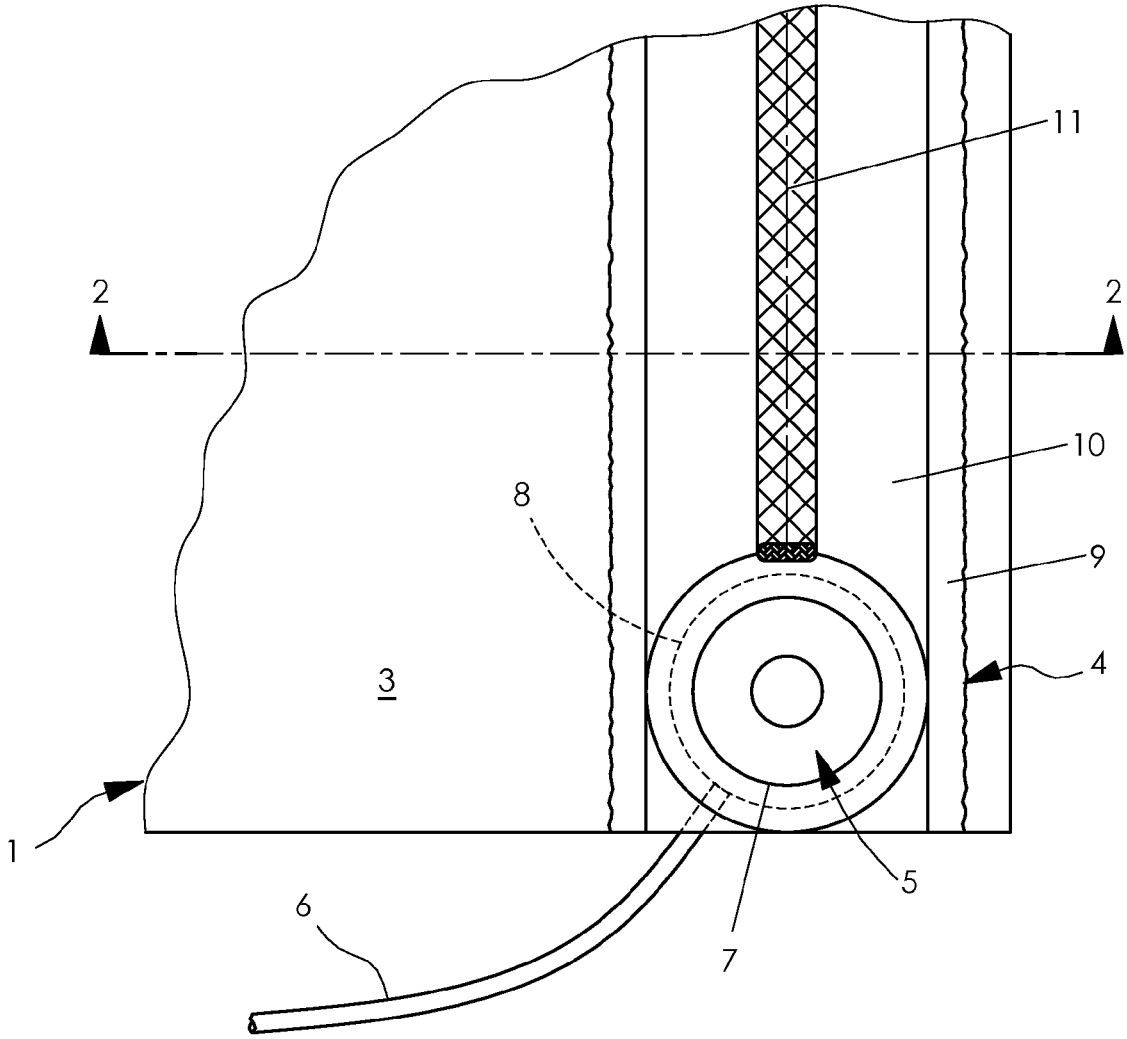
FIG. 1 is a schematic perspective view of a first embodiment of the invention.

It will be understood that whilst one rail is discussed in relation to the drawings, there are two or more rails in parallel spaced relationship in the sheet of semi-conductive material. It will also be understood that the thicknesses of the coatings illustrated in the drawings are exaggerated for clarity.

In the drawings, a flexible semi-conductive material is in the form of a flexible sheet 1 with a fabric backing 2 provided with a surface 3 of semi-conductive material formed predominantly of carbon. Such material is sold under the Registered Trade Mark Inditherm, and is discussed in International Patent Publication WO 00/34959. The semi-conductive surface 3 is provided with spaced rails indicated at 4 (one only illustrated) provided with an electrical connection 5 to a lead 6 extending to a source of electrical supply. The connection 5 is in the form of a press-stud 7 of conductive material, such as nickel coated brass securing an end fitting 8 on the lead 6 to the conductive rail.

Figure 2:
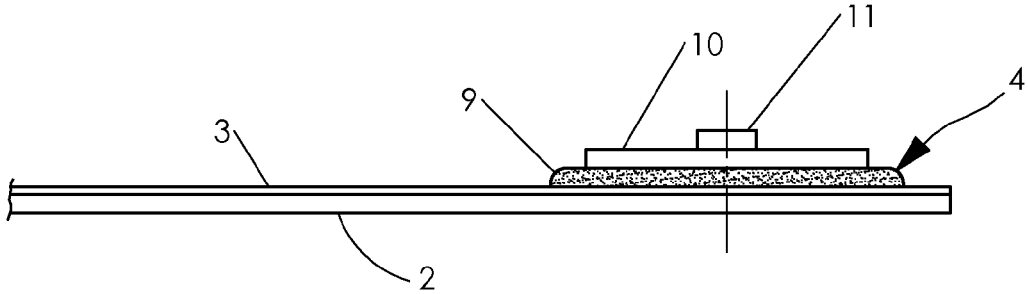
FIG. 2 is a section on the line 2-2 of FIG. 1.

In FIGS. 1 and 2, there is provided a rail 4 formed by first applying to the surface 3 a coating 9 of a nickel based compound to which is attached a strip 10 of conductive material such as for example a tin plated conductive metal foil the strip 10 being attached to the coating 9 by way of an electrically conductive adhesive.

To the exposed surface of the strip 10, there is secured a supplementary rail 11 in the form of a braid created from conductive wires, the diameters of which are such that the braid is accorded a considerable individual flexibility commensurate with the flexibility of the sheet 1. The braid forming the supplementary rail 11 may be attached to the surface of the conductive strip 10 by a conductive adhesive, or by stitching, or both, and the end of the braid is trapped by the press stud 7 in electrical contact with the end fitting 8 on the lead 6.

Figure 3:
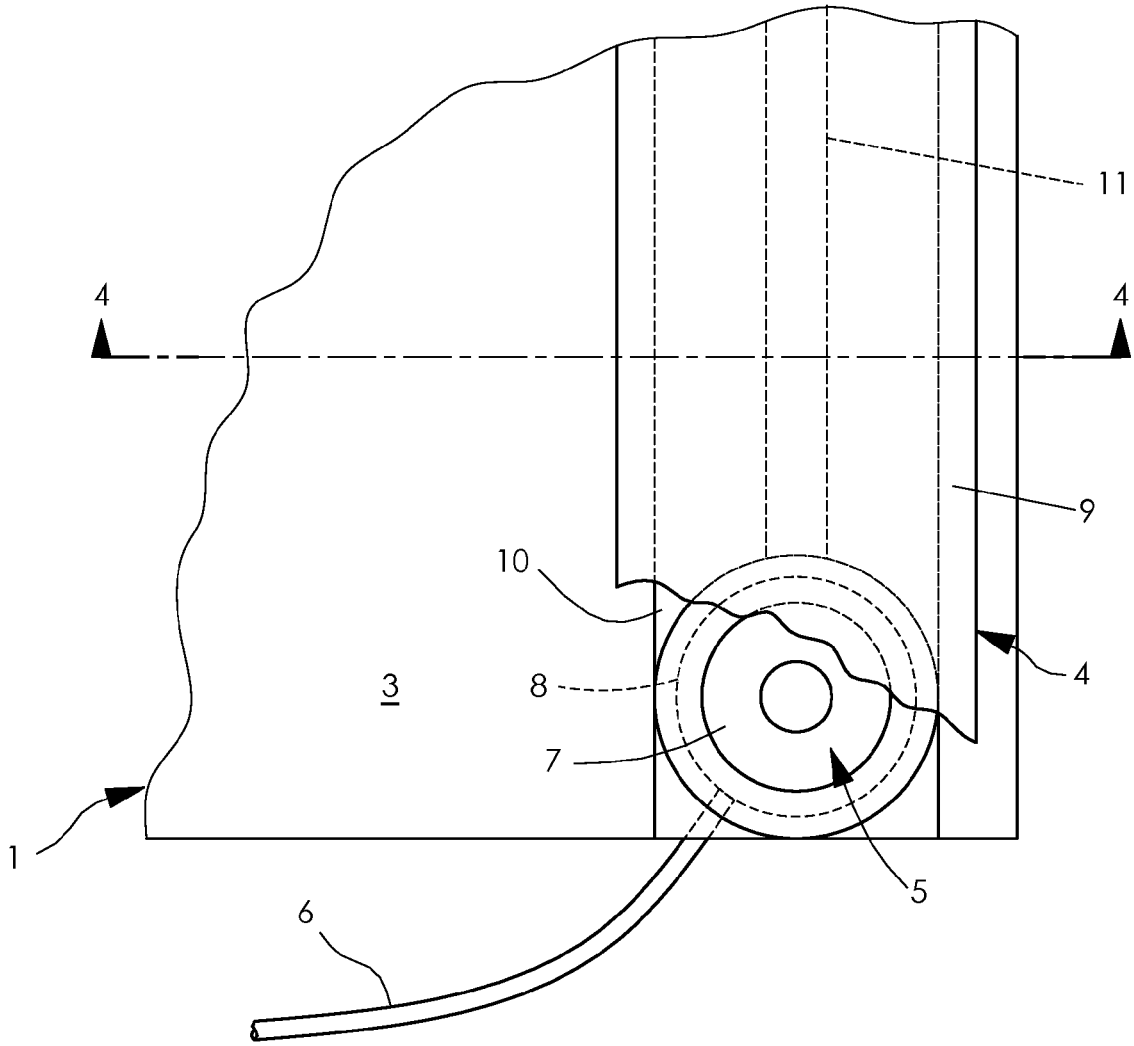
FIG. 3 corresponds to FIG. 1 but shows a second embodiment of the invention.
Figure 4:
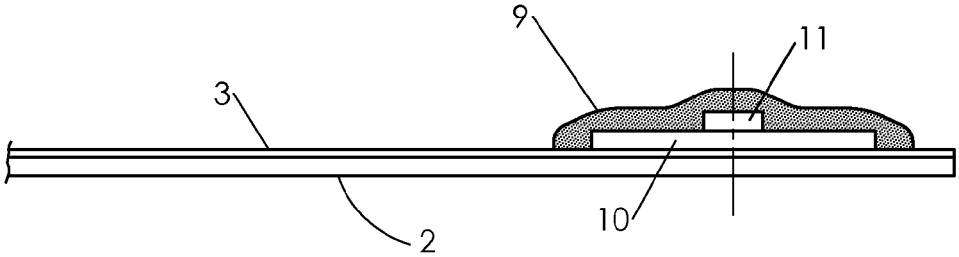
FIG. 4 is a section on the line 4-4 of FIG. 3.

The purpose of the coating 9 of nickel based compound is to ensure that there is no undesirable electrical arcing as between the conductive strip and the surface 3 of semi-conductive material. This can also be achieved by the alternative arrangement shown in FIGS. 3 and 4. Here, the electrically conductive strip 10 is secured by electrically conductive adhesive directly to the surface 3 of semi-conductive material, and to which the supplementary rail 11 formed from braided wire is attached. This is then overlaid by the coating 9 of a nickel based compound.

Figure 5:
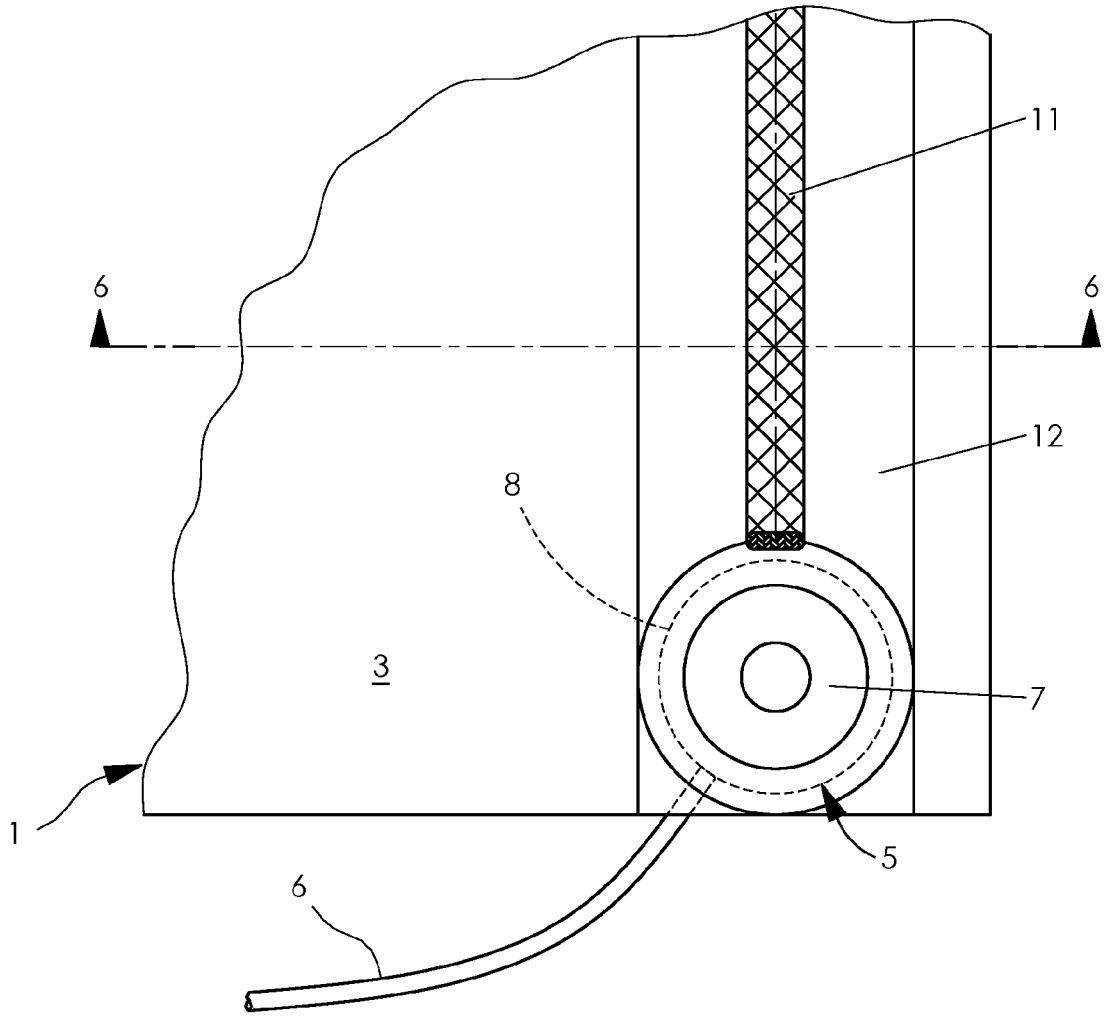
FIG. 5 corresponds to FIG. 1 but shows a third embodiment of the invention and FIG. 6 is a section on the line 6-6 of FIG. 5.
Figure 6:
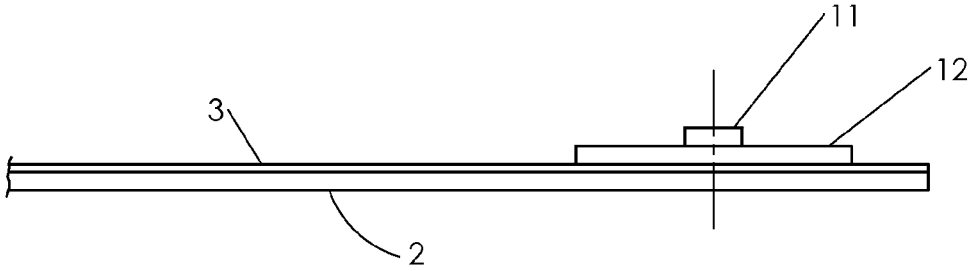

In the still further embodiment of the invention illustrated in FIGS. 5 and 6, the rail 4 is formed by the screen printing of a conductive ink as a stripe 12 along the surface 3 of semi-conductive material, the conductive strip again being connected to an electrical power source by a press-stud 7 securing the end fitting of an electrical lead 6 against the surface of the conductive ink stripe 12. The supplementary rail 11 formed from braided wire is secured to the conductive stripe 12 by adhesive, by stitching or both, and the end of the braid is trapped by the press-stud 7 in contact with the end fitting on the lead 6.

Whilst the flexible semi-conductive sheet is of itself relatively robust as are the means of attaching a conductive rail, over-robust handling, and the employment of clamps to hold the sheet material in place can in certain circumstances damage the rail, to the detriment of the heating characteristics of the sheet as a whole. By providing a high strength yet flexible supplementary rail of e.g. braided wire, there is provided the substantial guarantee that electrical supply extends over the full length of the rail.

In addition to this, there are circumstances where two or more sheets of semi-conductive material need to be employed in the same heating arrangement, and when the supplementary rail serves ideally as the means of electrically connecting one sheet to an adjacent sheet.

The invention claimed is:

1. A flexible semi-conductive material in sheet form characterized by spaced first rails for the supply and return of electrical power, the said rails having a flexibility compatible with the semi-conductive material, and there being a supplementary rail attached to each first rail along the length thereof, the supplementary rails being flexible and having strength characteristics greater than those of the first rails, characterised in that the supplementary rails are a braid formed from conductive wires, the wire diameters being of a size that affords considerable individual flexibility, but relatively low strength, but which when interwoven with other wires, forms a braid that has a flexibility that is commensurate with the flexibility of the sheet of semiconductive material and the first rails.

2. A flexible semi-conductive material in sheet form as in claim 1, characterised in that the first rails are formed by a tin plated conductive foil.

3. A flexible semi-conductive material in sheet form as in claim 2, characterised in that the surface of the semi-conductive material is provided with a coating of an antifaying compound to which the first rails are attached by an electrically conductive adhesive.

4. A flexible semi-conductive material in sheet form as in claim 3, wherein the antifaying compound is a nickel based compound.

5. A flexible semi-conductive material in sheet form as in claim 1, characterised in that the first rails are attached directly to the surface of the semi-conductive material by an electrically conductive material, the supplementary rail being attached to the first rail and the first rail and supplementary rail being overlaid by an antifaying compound.

6. A flexible semi-conductive material in sheet form as in claim 5, characterised in that the antifaying compound is a nickel based compound.

7. A flexible semi-conductive material in sheet form as in claim 1, characterised in that the first rails are formed by conductive ink.

8. A flexible semi-conductive material in sheet form as in claim 7, characterised in that rail of conductive ink is applied to the surface of the flexible semi-conductive surface by screen printing.

9. A flexible semi-conductive material in sheet form as in claim 1, characterised in that the supplementary rail is attached to the first rail by an electrically conductive ink and/or by stitching.

* * * * *